US007997346B2

(12) United States Patent
Marshall

(10) Patent No.: US 7,997,346 B2
(45) Date of Patent: Aug. 16, 2011

(54) PERCUSSION DRILLING ASSEMBLY WITH ANNULAR LOCKING MEMBER

(75) Inventor: Alan J. Marshall, Lost Creek, WV (US)

(73) Assignee: Smith International, Inc., Houston, TX (US)

( * ) Notice: Subject to any disclaimer, the term of this patent is extended or adjusted under 35 U.S.C. 154(b) by 198 days.

(21) Appl. No.: 12/329,973

(22) Filed: Dec. 8, 2008

(65) Prior Publication Data

US 2010/0139979 A1 Jun. 10, 2010

(51) Int. Cl.
*E21B 10/36* (2006.01)

(52) U.S. Cl. ..... 166/378; 175/293; 175/306

(58) Field of Classification Search ..... 175/293, 175/294, 296, 306, 415; 166/378; 29/456; 285/330, 382, 922, 913; 411/122, 123, 129
See application file for complete search history.

(56) References Cited

U.S. PATENT DOCUMENTS 2,252,912 A * 8/1941 Armentrout ..... 175/234
2,887,891 A * 5/1959 Perez ..... 474/171

* cited by examiner

*Primary Examiner* — William P Neuder
*Assistant Examiner* — Cathleen R Hutchins
(74) *Attorney, Agent, or Firm* — Osha • Liang LLP

(57) ABSTRACT

A percussion drilling assembly for boring into the earth. In an embodiment, the assembly comprises a tubular case having a central axis and a lower end. In addition, the assembly comprises a driver sub having an upper end threadingly engaged with the lower end of the case. Further, the assembly comprises a annular locking member disposed about the driver sub. The annular locking member engages the case and the driver sub and restricts the rotation of the driver sub relative to the case about the central axis.

11 Claims, 10 Drawing Sheets

PERCUSSION DRILLING ASSEMBLY WITH ANNULAR LOCKING MEMBER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of Art

The disclosure relates generally to earth boring bits used to drill a borehole for applications including the recovery of oil, gas or minerals, mining, blast holes, water wells and construction projects. More particularly, the disclosure relates to percussion hammer drill bits. Still more particularly, the disclosure relates to percussion hammer drill bits including a driver sub that is rotationally locked relative to a casing.

2. Background of Related Art

In percussion or hammer drilling operations, a drill bit mounted to the lower end of a drill string simultaneously rotates and impacts the earth in a cyclic fashion to crush, break, and loosen formation material. In such operations, the mechanism for penetrating the earthen formation is of an impacting nature, rather than shearing. The impacting and rotating hammer bit engages the earthen formation and proceeds to form a borehole along a predetermined path toward a target zone. The borehole created will have a diameter generally equal to the diameter or "gage" of the drill bit.

Referring to FIGS. 1-3, a conventional percussion drilling assembly 10 for drilling through formations of rock to form a borehole is shown. Assembly 10 is connected to the lower end of a drillstring 11 (FIG. 3) and includes a top sub 20, a driver sub 40, a tubular case 30 axially disposed between top sub 20 and driver sub 40, a piston 35 slidably disposed in the tubular case 30, and a hammer bit 60 slidingly received by driver sub 40. A feed tube 50 extends between top sub 20 and piston 35.

The upper end of top sub 20 is threadingly coupled to the lower end of drillstring 11 (FIG. 3), and the lower end up top sub 20 is threadingly coupled to the upper end of case 30. Further, the lower end of case 30 is threadingly coupled to the upper end of driver sub 40. Hammer bit 60 slideably engages driver sub 40. A series of generally axial mating splines 61, 41 on bit 60 and driver sub 40, respectively, allow bit 60 to move axially relative to driver sub 40 while simultaneously allowing driver sub 40 to rotate bit 60 with drillstring 11 and case 30.

Hammer bit 60 is generally cylindrical in shape and includes a radially outer skirt surface 62 aligned with or slightly recessed from the borehole sidewall and a bottomhole facing cutting or bit face 64. The earth disintegrating action of the hammer bit 60 is enhanced by providing a plurality of cutting elements (not shown) that extend from the cutting face 64 for engaging and breaking up the formation. The cutting elements are typically inserts formed of a superhard or ultrahard material, such as polycrystalline diamond (PCD) coated tungsten carbide and sintered tungsten carbide, that are press fit into undersized apertures in bit face.

A guide sleeve 32 and a bit retainer ring 34 are also positioned in case 30 axially above driver sub 40. Guide sleeve 32 slidingly receives the lower end of piston 35. Bit retainer ring 34 is disposed about the upper end of hammer bit 60 and prevents hammer bit 60 from falling out of and completely disengaging driver sub 40.

A retainer sleeve 70 is coupled to driver sub 40 and extends along the outer periphery of hammer bit 60. Retainer sleeve 70 generally provides a secondary catch mechanism that allows the lower enlarged head of hammer bit 60 to be extracted from the wellbore upon lifting of the drill string 11 and percussion drilling assembly 10 in the event of a crack or break in the shank (rotational drive) section of bit 60.

During drilling operations, a compressed fluid (e.g., compressed air, compressed nitrogen, etc.) is delivered down the drill string 11 from the surface to percussion drilling assembly 10. In most cases, the compressed fluid is provided by one or more compressors at the surface. The compressed fluid serves to actuate piston 35 within case 30. As piston 35 moves reciprocally within case 30, it cyclically impacts hammer bit 60, which in turn cyclically impacts the formation to gouge, crush, and break the formation with the cutting elements mounted thereon. The compressed fluid ultimately exits the bit face 64 and serves to flush cuttings away from the bit face 64 to the surface through the annulus between the drill string and the borehole sidewall.

In addition, during drilling operations, drill string 11 and drilling assembly 10 are rotated. Mating splines 41, 61 on driver sub 40 and bit 60, respectively, allow bit 60 to move axially relative to driver sub 40 while simultaneously allowing driver sub 40 to rotate bit 60 with drillstring 11. As a result, the drill string rotation is transferred to the hammer bit 60. Rotary motion of the drill string 11 may be powered by a rotary table typically mounted on the rig platform or top drive head mounted on the derrick. The rotation of hammer bit 60 allows the cutting elements of bit 60 to be "indexed" to fresh rock formations during each impact of bit 60, thereby improving the efficiency of the drilling operation. Without indexing, the cutting structure extending from the lower face 64 of the hammer bit 60 may have a tendency to undesirably impact the same portion of the earth as the previous impact. Experience has demonstrated that for an eight inch hammer bit (e.g., hammer bit 60), a rotational speed of approximately 20 rpm and an impact frequency of 1600 bpm (beats per minute) typically result in relatively efficient drilling operations. This rotational speed translates to an angular displacement of approximately 5 to 10 degrees per impact of the bit against the rock formation.

In oil and gas drilling, the cost of drilling a borehole is very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense.

As previously described, in most conventional bits, the driver sub 40 is threadingly coupled to the lower end of the case 30. During drilling, repeated impacts and vibration of the percussion drilling assembly 10 occasionally results in the inadvertent unthreading of the driver sub 40 from the case 30, resulting in the complete disengagement of the driver sub 40 and the drill bit 60 from the remainder of the percussion drilling assembly 10 and drillstring 11. Although the bit retainer ring 34 and the retainer sleeve 70 restrict the drill bit 60 from disengaging the driver sub 40, they typically do not restrict the unthreading and disengagement of the driver sub 40 from the case 30.

Once the driver sub 40 and the drill bit 60 are decoupled from the remainder of the percussion drilling assembly 10, the entire drill string 11 must be pulled to replace the dropped bit 60. Further, a fishing operation may be required to retrieve the dropped bit 60. Such tripping and fishing operations undesirably increase the time and cost required to complete the borehole.

Accordingly, there is a need for devices and methods that reduced the likelihood of inadvertent unthreading of the driver sub and case of a percussion drilling assembly. Such devices and methods would be particularly well received if they were relatively inexpensive, simple to manufacture, and did not otherwise interfere with the operation of the percussion drilling assembly.

SUMMARY OF SOME OF THE PREFERRED EMBODIMENTS

These and other needs in the art are addressed in one embodiment by a percussion drilling assembly for boring into the earth. In an embodiment, the assembly comprises a tubular case having a central axis and a lower end. In addition, the assembly comprises a driver sub having an upper end threadingly engaged with the lower end of the case. Further, the assembly comprises a annular locking member disposed about the driver sub. The annular locking member engages the case and the driver sub, and restricts the rotation of the driver sub relative to the case about the central axis.

These and other needs in the art are addressed in another embodiment by a method for drilling an earthen borehole. In an embodiment, the method comprises disposing a percussion drilling assembly downhole on a drillstring. The percussion drilling assembly comprises a tubular case having a central axis and coupled to the drillstring, a driver sub having an upper end threadingly coupled to a lower end of the case, and a hammer bit slidingly received by the driver sub. In addition, the method comprises restricting the rotation of the driver sub relative to the case with a annular locking member disposed about the driver sub at the lower end of the case.

These and other needs in the art are addressed in another embodiment by a method of manufacturing a percussion drilling assembly. In an embodiment, the method comprises providing a tubular case having a central axis and a lower end with an inner surface and an outer surface. The inner surface of the lower end includes internal threads and the outer surface of the lower end includes a groove. In addition, the method comprises providing a driver sub having a central axis, an outer surface, and an upper end. The outer surface of the upper end includes external threads and the outer surface axially below the outer includes a groove. Further, the method comprises providing a annular locking member including an annular body, an inner finger extending radially inward from the body, and a first outer finger extending radially outward from the body. Still further, the method comprises positioning the annular locking member about the driver sub. Moreover, the method comprises threading the upper end of the driver sub to the lower end of the case.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
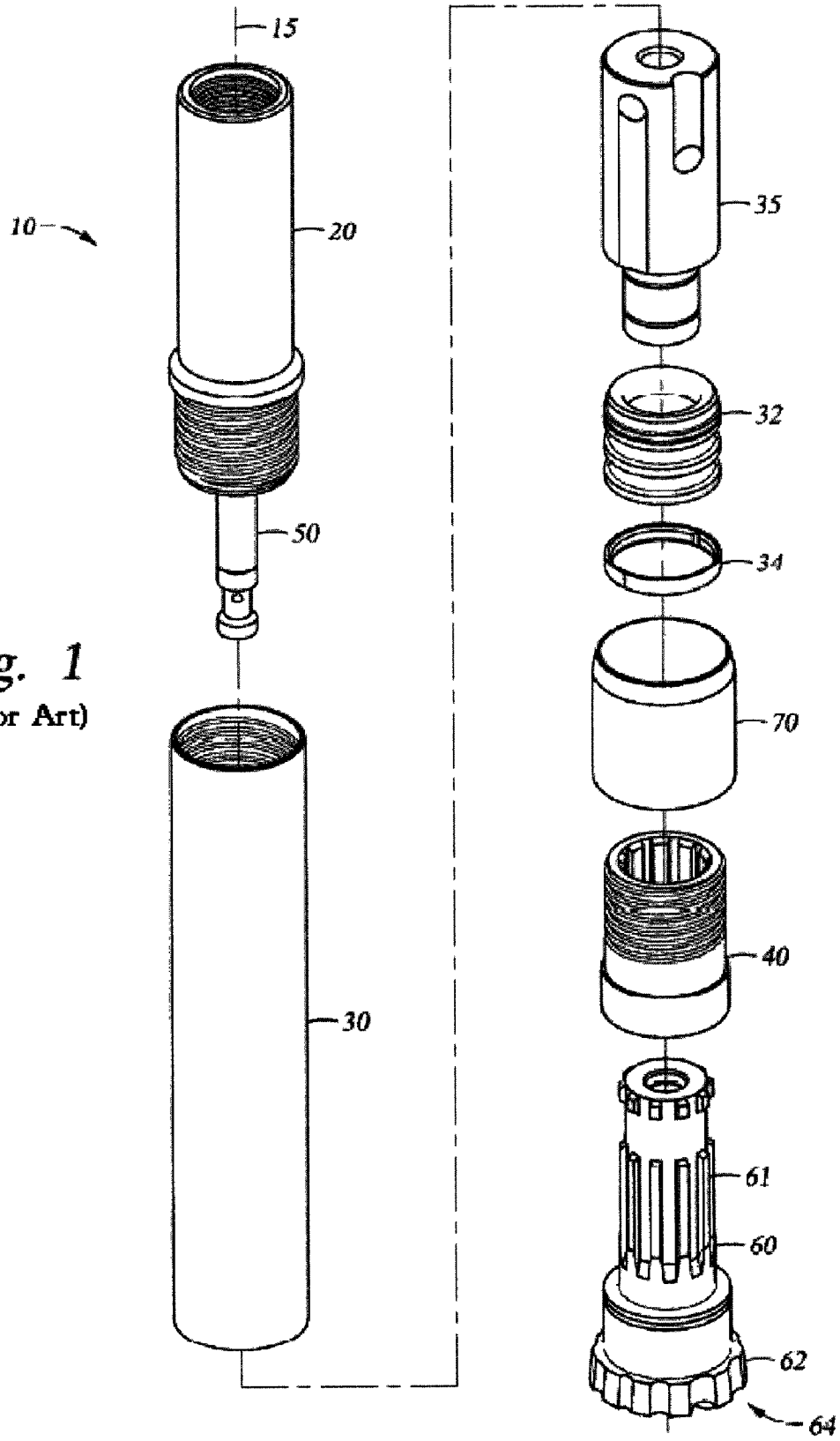
Fig. 1 (Prior Art)
FIG. 1 is an exploded perspective view of a conventional percussion drilling assembly.
Figure 2:
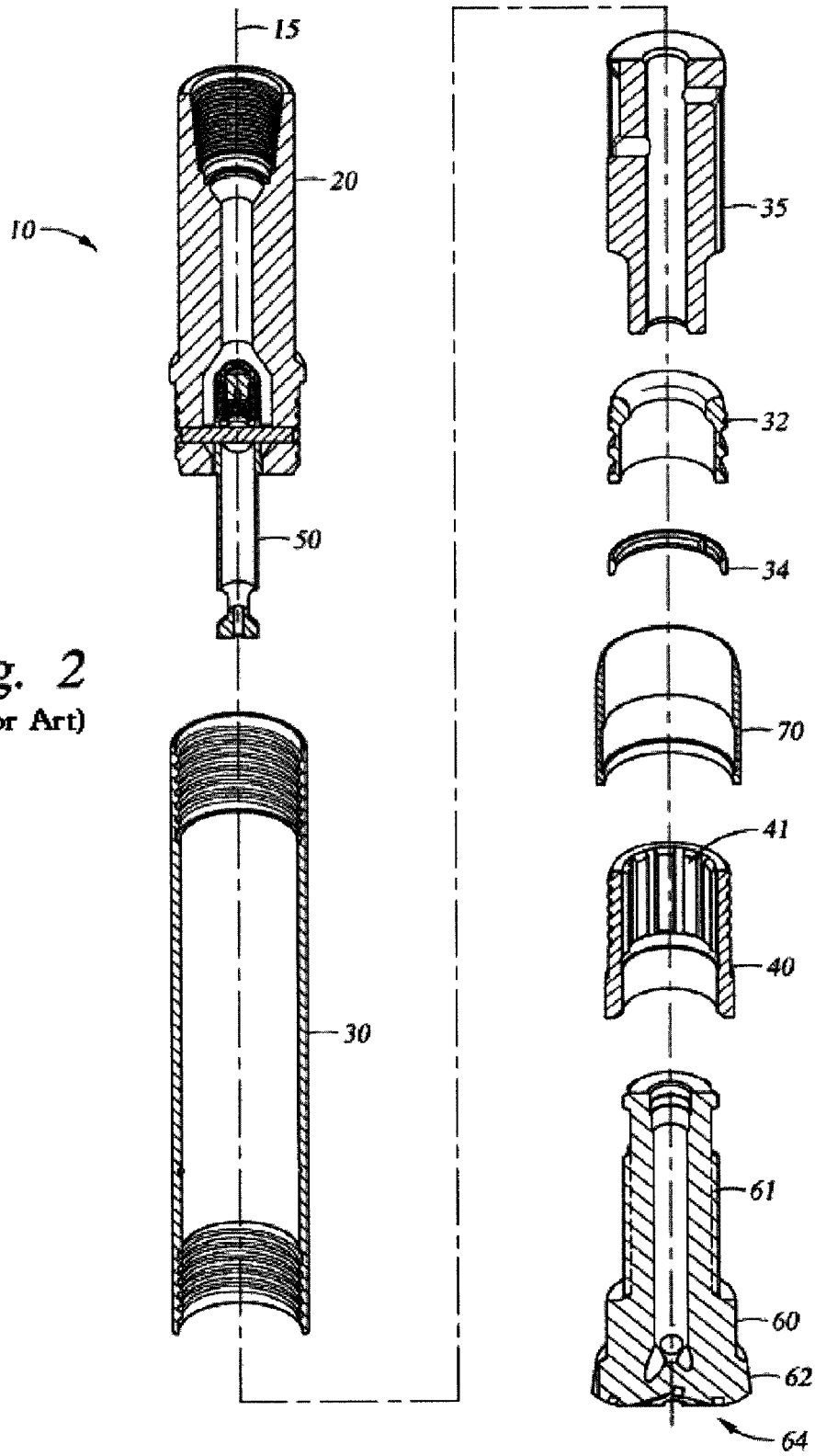
Fig. 2 (Prior Art)
FIG. 2 is an exploded, cross-sectional view of the percussion drilling assembly of FIG. 1.
Figure 3:
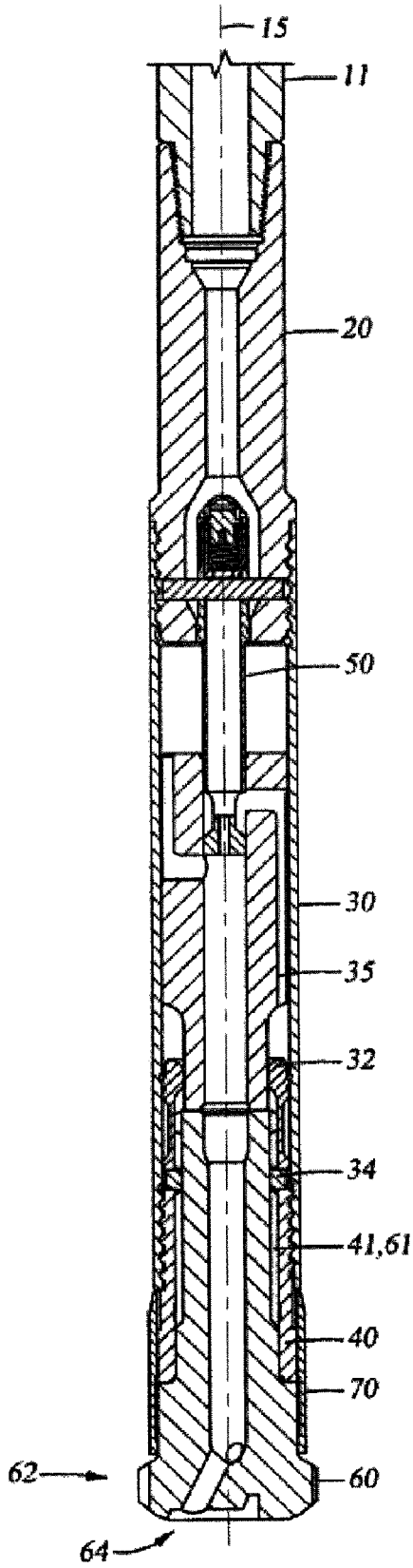
Fig. 3 (Prior Art)
FIG. 3 is a cross-sectional view of the percussion drilling assembly of FIG. 1 connected to the lower end of a drillstring.

The following discussion is directed to various exemplary embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection.

Thus, if a first device couples to a second device, that connection may be through a direct connection, or through an indirect connection via other devices and connections. Further, the terms "axial" and "axially" generally mean along or parallel to a central or longitudinal axis, while the terms "radial" and "radially" generally mean perpendicular to a central longitudinal axis.

Figure 4:
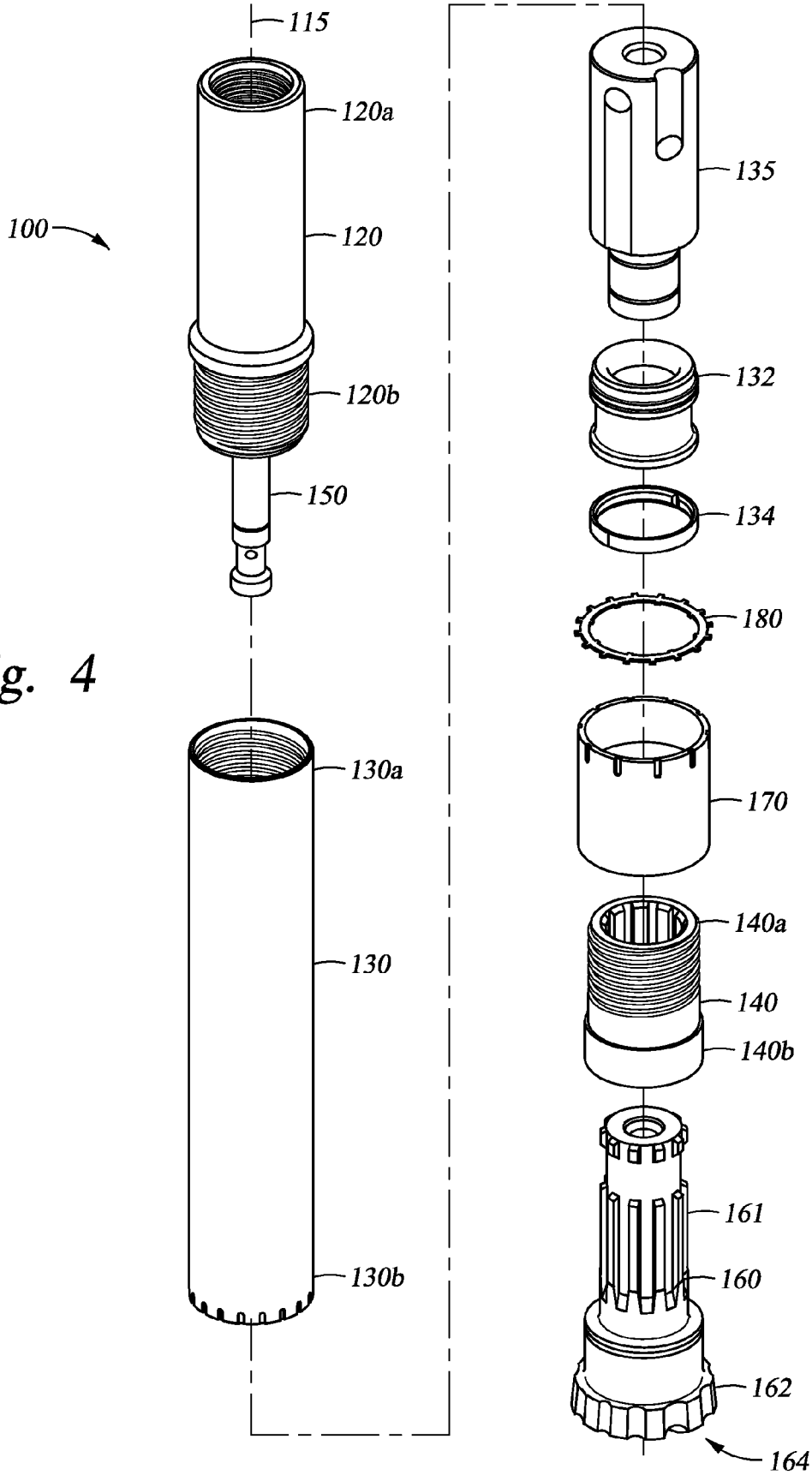
FIG. 4 is an exploded perspective view of an embodiment of percussion drilling assembly in accordance with the principles described herein.
Figure 5:
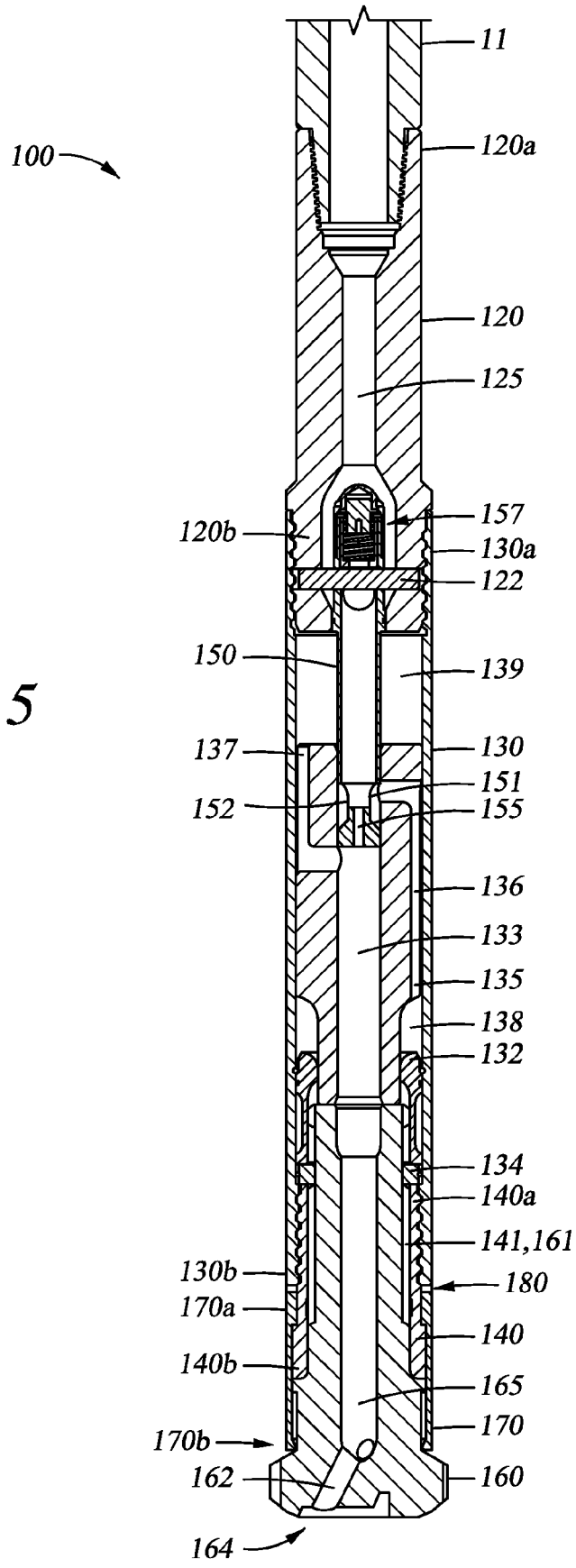
FIG. 5 is a cross-sectional view of the percussion drilling assembly of FIG. 4.

Referring now to FIGS. 4 and 5, an embodiment of a percussion drilling assembly 100 in accordance with the principles described herein is shown. Assembly 100 is employed to drill through formations of rock to form a borehole for the ultimate recovery of oil and gas. Similar to conventional percussion drilling assembly 10 previously described, assembly 100 is connected to the lower end of a drillstring 11 (FIG. 5) and includes a top sub 120, a driver sub 140, a tubular case 130 axially disposed between top sub 120 and driver sub 140, a piston 135 slidably disposed in the tubular case 130, and a hammer bit 160 slidingly received by driver sub 140. As best shown in FIG. 5, top sub 120 has an upper end 120*a* and a lower end 120*b*, case 130 has an upper end 130*a* and a lower end 130*b*, and driver sub 140 has an upper end 140*a* and a lower end 140*b*. Upper end 120*a* of top sub 120 is threadingly coupled to the lower end of drillstring 11, and lower end 120*b* of top sub 120 is threadingly coupled to upper end 130*a* of case 130. Further, lower end 130 *b* of case 130 is threadingly coupled to upper end 140*a* of driver sub 140. A fluid conduit 150 extends between top sub 120 and piston 135. Top sub 120, case 130, piston 135, driver sub 140, and hammer bit 160 are generally coaxially aligned, each sharing a common central or longitudinal axis 115.

Top sub 120 includes a central through passage 125 in fluid communication with drillstring 11. The upper end of fluid conduit 150 is received by passage 125, and coupled to top sub 120 with a pin 122 extending through top sub 120 and fluid conduit 150. A check valve 157 is coupled to the upper end of fluid conduit 150 and allows one-way fluid communication between passage 125 and fluid conduit 150. When check valve 157 is in the opened position, drillstring 11 and fluid conduit 150 are in fluid communication. However, when check valve 157 is in the closed position, fluid communication between drillstring 11 and fluid conduit 150 is restricted. In this manner, check valve 157 restricts the back flow of cuttings from the wellbore into drillstring 11. The lower end of fluid conduit 150 includes circumferentially spaced radial outlet ports 151, 152 and an axial bypass choke 155.

Referring still to FIGS. 4 and 5, piston 135 is slidingly disposed in case 130 above hammer bit 160 and cyclically impacts hammer bit 160. A piston passage 133 in piston 135 slidingly receives the lower end of feed tube 150. Piston 135 also includes a first set of flow passage 136 extending from piston passage 133 to a lower chamber 138, and a second set of flow passage 137 extending from piston passage 133 to an upper chamber 139. Lower chamber 138 is defined by case 130, the lower end of piston 135, and guide sleeve 132, and upper chamber 139 is defined by case 130, the upper end of piston 135, and the lower end of top sub 120.

During drilling operations, piston 135 is reciprocally actuated within case 130 by alternating the flow of the compressed fluid (e.g., pressurized air) between passage 136, 137 and chambers 138, 139, respectively. More specifically, piston 135 has a first axial position and a second axial position. In the first axial position, the outlet port 151 is axially aligned with passage 136, thereby placing the first outlet port 151 in fluid communication with passage 136 and chamber 138. In the second axial position, the second outlet port 152 is axially aligned with passage 137, thereby placing second outlet port 152 in fluid communication with passage 137 and chamber 139. The intersection of passages 133, 136 is axially spaced from the intersection of passages 133, 137, and thus, when first outlet port 151 is aligned with passage 136, second outlet port 152 is not aligned with passage 137 and vice versa. It should be appreciated that piston 135 assumes a plurality of axial positions between the first position and the second position, each allowing varying degrees of fluid communication between ports 151, 152 and passage 136, 137, respectively.

Guide sleeve 132 and a bit retainer ring 134 are also positioned in case 130 axially above driver sub 140. Guide sleeve 132 slidingly receives the lower end of piston 135. Bit retainer ring 134 is disposed about the upper end of hammer bit 160 and restricts disengagement of hammer bit 160 and the remainder of assembly 100.

Referring still to FIGS. 4 and 5, hammer bit 160 slideably engages driver sub 140. More specifically, a series of generally axial mating splines 161, 141 on bit 60 and driver sub 140, respectively, allow bit 160 to move axially relative to driver sub 140 while simultaneously allowing driver sub 140 to rotate bit 160 with drillstring 11 and case 130. A retainer sleeve 170 is coupled to driver sub 140 and extends along the outer periphery of hammer bit 160. Retainer sleeve 170 has an upper end 170*a* disposed about and coupled to lower end 140*b* of driver sub 140, and a lower end 140*b* extending axially below driver sub 140 along the outside of hammer bit 160. As described in U.S. Pat. No. 5,065,827, which is hereby incorporated herein by reference in its entirety, the retainer sleeve 170 generally provides a secondary catch mechanism that allows the lower enlarged head of hammer bit 60 to be extracted from the wellbore in the event of a breakage of the upper shank of hammer bit 160. In addition, hammer bit 160 includes a bit passage 165 in fluid communication with downwardly extending passages 162 having ports or nozzles 164 formed in the face of hammer bit 160. Bit passage 165 is also in fluid communication with piston passage 133. Guide sleeve 132 maintains fluid communication between bores 133, 165 as piston 135 moves axially upward relative to hammer bit 160. Compressed fluid exhausted from chambers 138, 139 into piston passage 133 of piston 135 flows through bit passages 165, 162 and out ports or nozzles 164. Together, passages 162 and nozzles 164 serve to distribute compressed fluid around the face of bit 160 to flush away formation cuttings during drilling and to remove heat from bit 160.

During drilling operations, drill string 11 and drilling assembly 10 are rotated. Mating splines 161, 141 on bit 160 and driver sub 140, respectively, allow bit 60 to move axially relative to driver sub 140 while simultaneously allowing driver sub 140 to rotate bit 160 with drillstring 11. The rotation of hammer bit 60 allows the cutting elements (not shown) of bit 160 to be "indexed" to fresh rock formations during each impact of bit 160, thereby improving the efficiency of the drilling operation.

In this embodiment, compressed fluid (e.g., compressed air or nitrogen) flows axially down drillstring 11, passage 125, and fluid conduit 150. At the lower end of fluid conduit 150, the compressed fluid flows radially outward through ports 151, 152, passages 136, 137, respectively, to chamber 138, 139, respectively, thereby actuating piston 135. In such percussion drilling assembly designs in which the compressed fluid flows down the drill string and radially outward to the piston-cylinder chambers, the fluid conduit extending between the top sub and the piston is generally referred to as a "feed tube." In other embodiments, the percussion drilling assembly may alternatively utilize an air distributor design, in which compressed air is directed radially inward from an outer radial location into the upper and lower piston-cylinder chambers to actuate the piston. Embodiments described herein may be employed in either feed tube design or air distributor design percussion drilling assemblies.

As previously described, in some conventional percussion drilling assemblies, the driver sub may inadvertently begin to rotate relative to the case, resulting in unthreading of the driver sub from the case. The unthreading of the case and the driver sub may be triggered by a number of factors including, without limitation, vibrations in the percussion drilling assembly, the driver sub not being torqued to specification relative to the case, the repeated impacts of the piston and the hammer bit, or combinations thereof. Since most conventional percussion drilling assemblies rely exclusively on proper torquing of the driver sub and resulting friction at the interface of the mating threads on the driver sub and the case, once unthreading begins it is may continue until the driver sub completely disengages from the case. If the driver sub completely disengages the case, the guide sleeve, the retainer ring, the retainer sleeve, and the hammer bit will also become disengaged along with the driver sub. It should be appreciated that although the retainer ring and the retainer sleeve prevent the complete disengagement of the hammer bit from the driver sub, they are not intended to prevent disengagement of the driver sub from the case in the event of unthreading. Consequently, the inadvertent unthreading and disengagement of the driver sub from the case typically requires an expensive trip of the drill string, replacement of the hammer bit, and fishing expedition. However, unlike most conventional percussion drilling assemblies (e.g., percussion drilling assembly 10), embodiments of percussion drilling assembly 100 described herein also include an annular locking member 180 disposed about driver sub 140, axially between case 130 and retainer sleeve 170 (FIG. 5). As will be described in more detail below, annular locking member 180 positively engages driver sub 140, case 130, and retainer sleeve 170, and restricts and/or prevents the relative rotation between case 130, driver sub 140, and retainer sleeve 170, thereby providing a mechanical lock that offers the potential to reduce the likelihood of an inadvertent unthreading of driver sub 140 from case 130. In this embodiment, annular locking member 180 is generally flat, and thus, may also be described as a lock washer.

Figure 6:
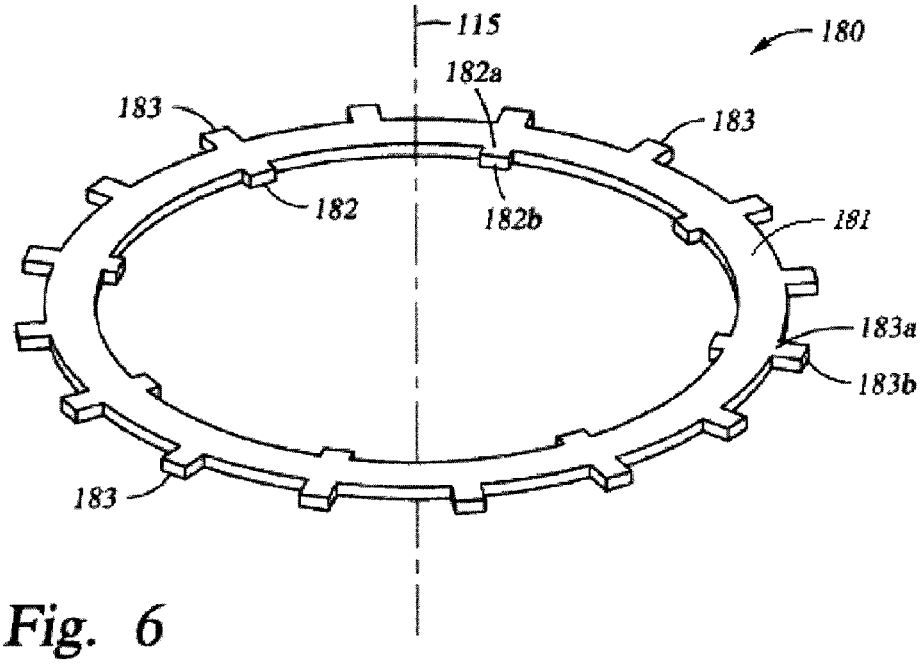
FIG. 6 is a perspective view of the annular locking member of FIGS. 4 and 5.

Referring now to FIG. 6, annular locking member 180 includes an annular or ring-shaped body 181, a plurality of circumferentially or angularly spaced internal or inner fingers 182 extending from the inner periphery of body 181, and a plurality of circumferentially spaced external or outer fingers 183 extending from the outer periphery of body 181. In particular, inner fingers 182 extend radially inward from body 181, and outer fingers 183 extend radially outward from body 181. Each inner finger 182 includes a fixed or body end 182*a* integral with body 181 and a free end 182*b* generally distal body 181. Similarly, each outer finger 183 includes a fixed or body end 183*a* and a free end 183*b* generally distal body 181. In this embodiment, there are eight inner fingers 182 uniformly angularly spaced about 45° apart about central axis 115, and sixteen outer fingers 183 uniformly angularly spaced about 22.5° apart about central axis 115. However, in other embodiments, a different number and/or angular spacing of inner fingers 182 and/or outer fingers 183 may be provided. Further, in this embodiment, each finger 182, 183 is radially oriented and extends substantially perpendicularly from body 181. However, in other embodiments, one or more inner fingers (e.g., inner fingers 182) and/or one or more outer fingers (e.g., outer fingers 183) may extend at an acute angle from body 181. Still further, although fingers 182, 183 are generally rectangular in this embodiment, in general, one or more inner fingers (e.g., inner fingers 182) and/or one or more outer fingers (e.g., outer fingers 183) may have any suitable shape and geometry including, without limitation, T-shaped, triangular, ovoid, L-shaped, etc. As will be described in more detail below, in this embodiment, upon assembly of percussion drilling assembly 100, one or more outer fingers 183 are re-oriented about 90° up or down relative to body 181 such that re-oriented outer fingers 183 are generally parallel to central axis 115. Thus, it should be appreciated that FIG. 6 illustrates annular locking member 180 prior to final assembly of percussion drilling assembly 100.

Figure 7:
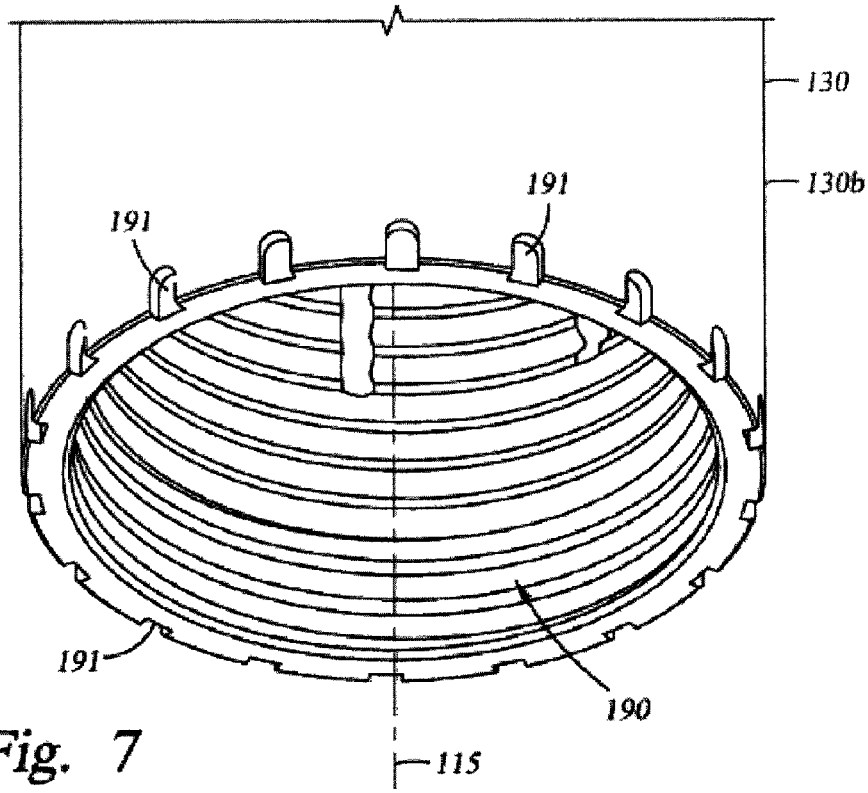
FIG. 7 is a partial perspective view of the case of FIGS. 4 and 5.

Referring now to FIG. 7, lower end 130*b* of generally cylindrical case 130 is shown. The inner surface of lower end 130*b* includes internal threads 190, and the outer surface of lower end 130*b* includes a plurality of circumferentially spaced axial grooves or recesses 191, each groove 191 being configured to receive and mate with one outer finger 183 of annular locking member 180. In this embodiment, grooves 191 are substantially parallel to each other and parallel to central axis 115. Further, in this embodiment, eighteen grooves 191 are uniformly angularly spaced about 20° apart. However, in other embodiments, a different number of grooves (e.g., grooves 191), orientation, and/or different angular spacing may be employed.

Figure 8:
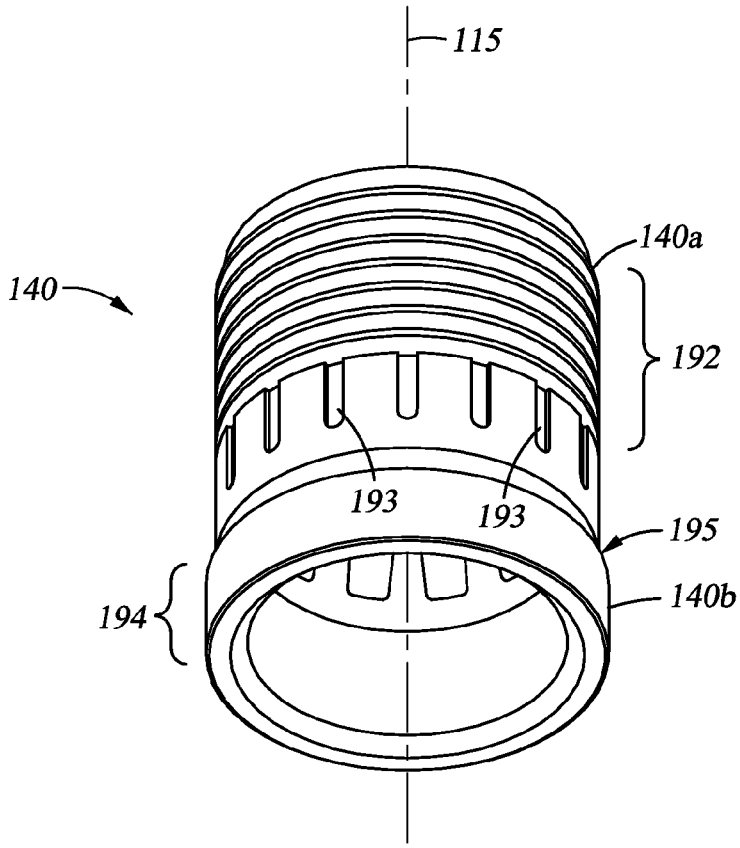
FIG. 8 is a perspective view of the driver sub of FIGS. 4 and 5.

Referring now to FIG. 8, generally cylindrical driver sub 140 is shown. The outer surface of upper end 140*a* includes external threads 192 that engage mating internal threads 190 of case 130. In addition, lower end 140*b* includes an increased outer radius section 194 defining an external annular shoulder. Disposed between threads 192 and shoulder 195, the outer surface of driver sub 140 includes a plurality of circumferentially spaced axial grooves or recesses 193, each groove 193 being configured to receive and mate with one inner finger 182 of annular locking member 180. In this embodiment, grooves 193 are substantially parallel to each other and parallel to central axis 115. Further, in this embodiment, sixteen grooves 193 are uniformly angularly spaced about 22.5° apart. However, in other embodiments, a different number of grooves (e.g., grooves 193), orientation, and/or different angular spacing may be employed. The number of grooves 193 in the outer surface of driver sub 140 is preferably the same or greater than the number of inner fingers 182 in locking member 180, and further, grooves 193 are preferably angularly spaced such that each inner finger 182 may be aligned with one groove 193.

Figure 9:
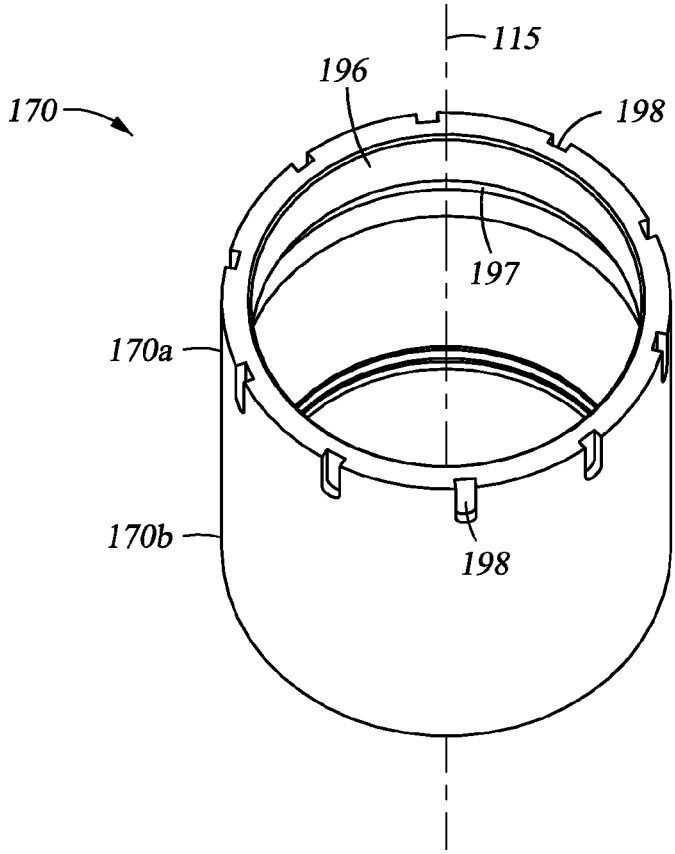
FIG. 9 is a perspective view of the retainer sleeve of FIGS. 4 and 5.

Referring now to FIG. 9, generally cylindrical retainer sleeve 170 is shown. The inner surface of upper end 170*a* includes a reduced inner radius section 196 defining an internal annular shoulder 197, and the outer surface of upper end 170*a* includes a plurality of circumferentially or angularly spaced axial grooves or recesses 198, each groove 198 being configured to receive and mate one outer finger 183 of annular locking member 180. In this embodiment, grooves 198 are substantially parallel to each other and parallel to central axis 115. Further, in this embodiment, ten grooves 198 are uniformly angularly spaced about 36° apart. However, in other embodiments, a different number of grooves (e.g., grooves 198), orientation, and/or different angular spacing may be employed.

Figure 10:
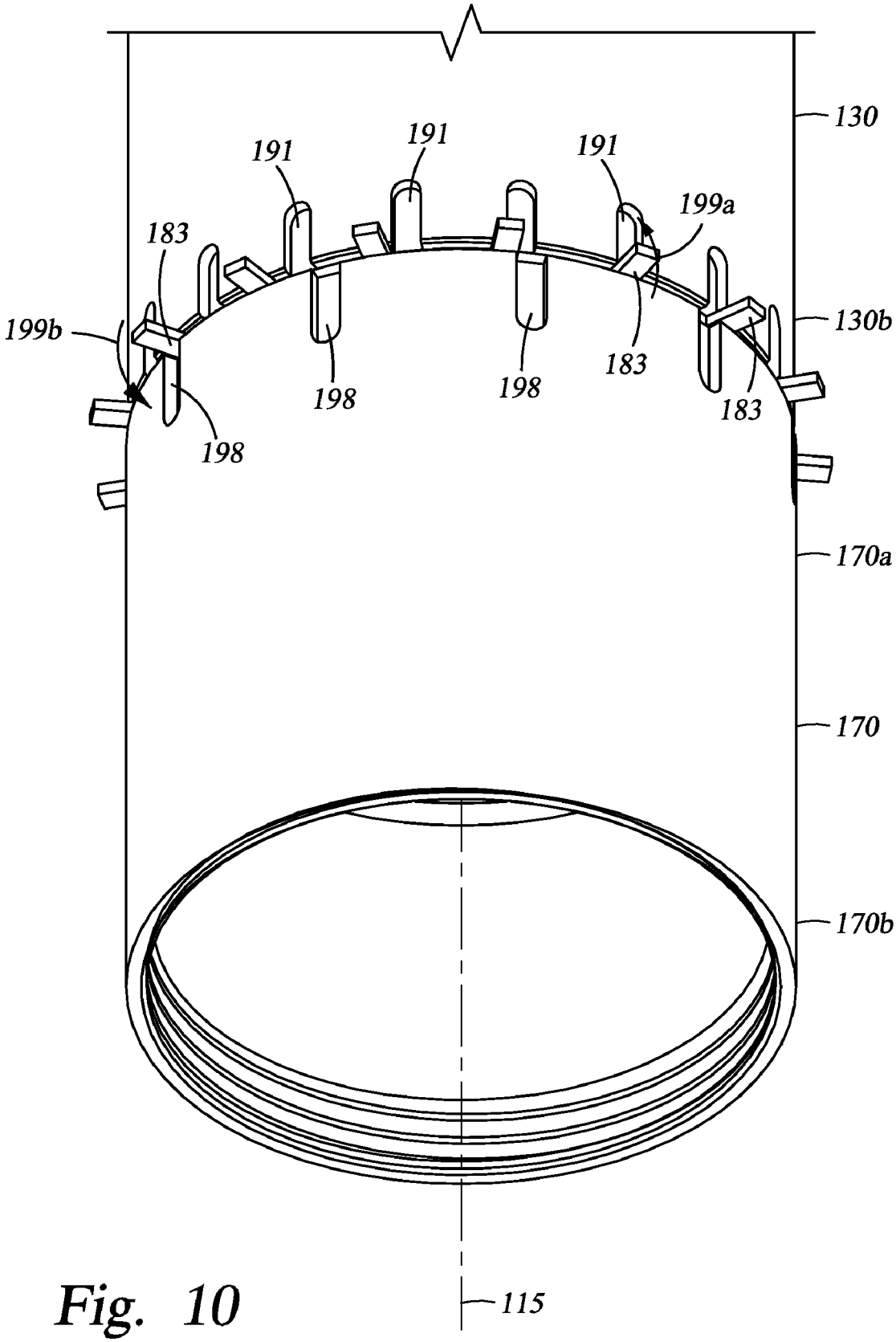
FIG. 10 is an enlarged partial perspective view of the case, retainer sleeve, and annular locking member of FIGS. 4 and 5 prior to final positioning of outer fingers of the annular locking member.
Figure 11:
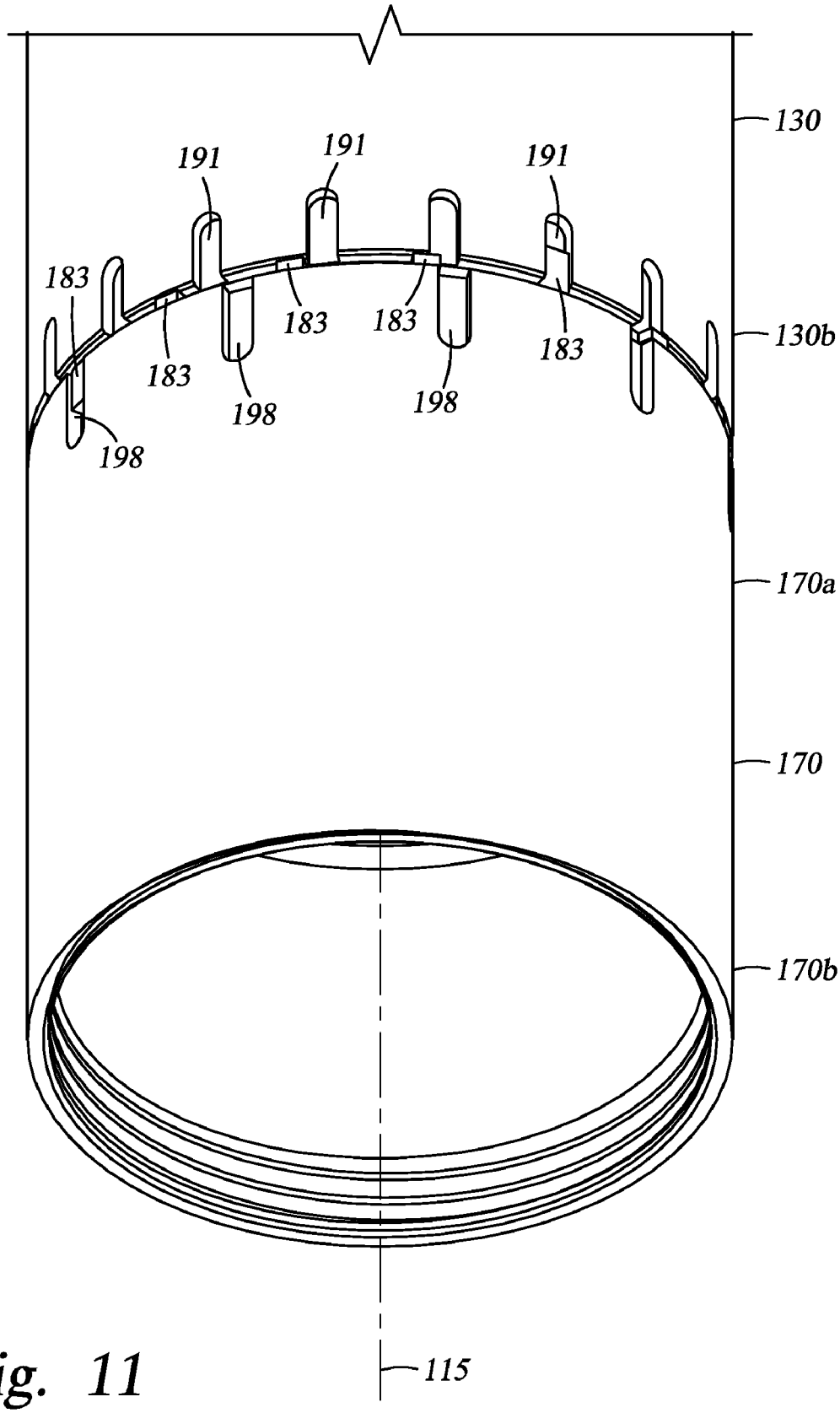
FIG. 11 is an enlarged partial perspective view of the case, retainer sleeve, and annular locking member of FIGS. 4 and 5 after final positioning of outer fingers of the annular locking member.
Figure 12:
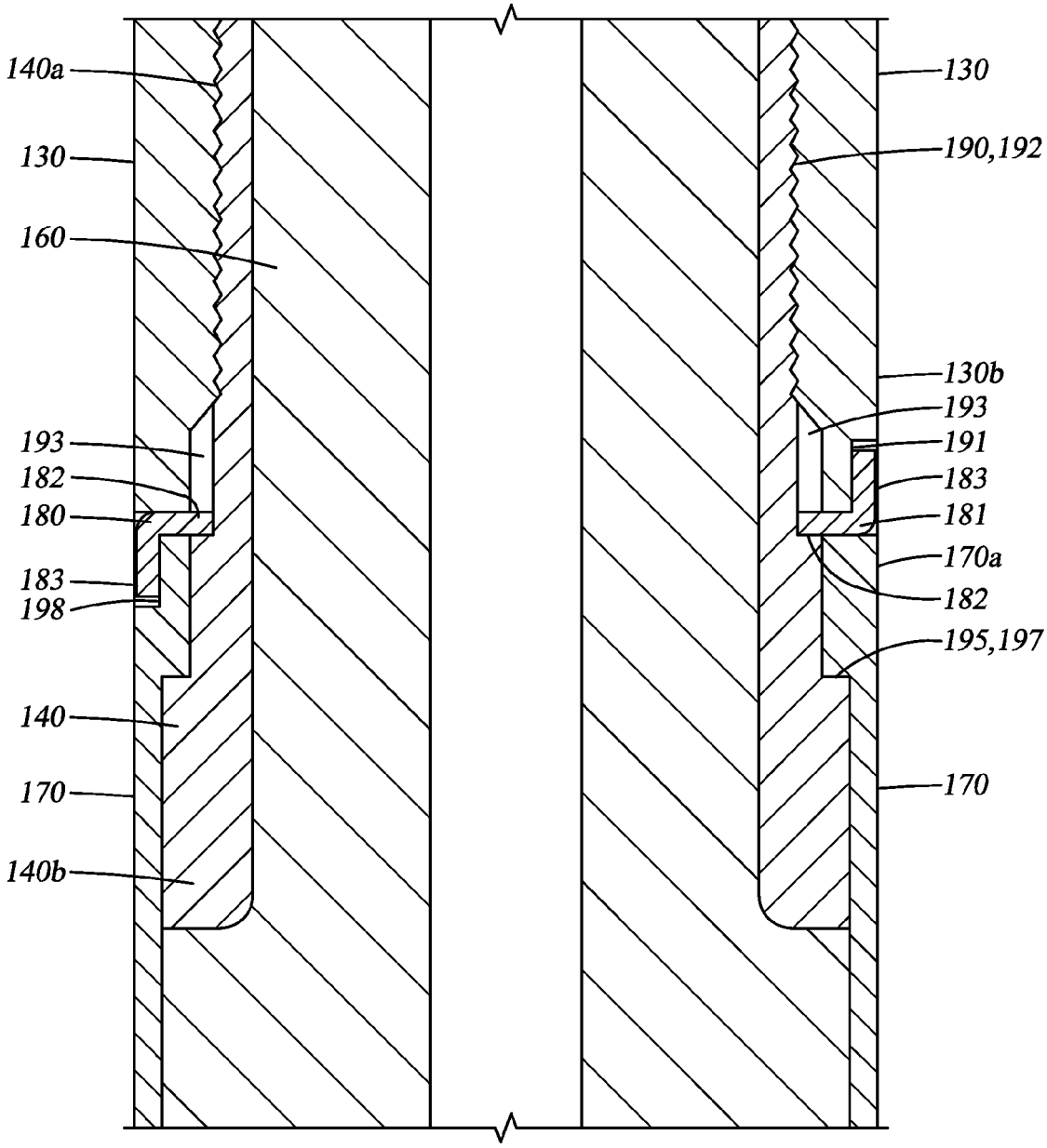
FIG. 12 is an enlarged partial cross-sectional view of the percussion drilling assembly of FIGS. 4 and 5.

Referring now to FIGS. 10-12, during assembly of percussion drilling assembly 100, upper end 170*a* of retainer sleeve 170 is disposed about lower end 140*b* of driver sub 140. In particular, retainer sleeve 170 is hung from driver sub 140 with internal shoulder 197 of retainer sleeve engaging external shoulder 195 of driver sub 140. Retainer ring 180 is then positioned about upper end 140*a* of driver sub 140 and moved axially downward toward grooves 193 and retainer sleeve 170. Before or as annular locking member 180 is moved axially downward, inner fingers 182 are circumferentially aligned with mating grooves 193 of driver sub 140, such that free end 182*b* of each inner finger 182 extends into and positively engage one of grooves 193. Inner fingers 182 are preferably sized and circumferentially spaced such that each inner finger 182 aligns with one groove 193. Once sufficiently positioned, inner fingers 182 are free to slide within grooves 193 as annular locking member 180 continues to be moved axially downward relative to driver sub 140 until body 181 engages upper end 170*a*.

With annular locking member 180 sufficiently positioned about driver sub 140 with fingers 181 disposed within grooves 193, bit 160 may be positioned within driver sub 140, and retainer ring 134 and guide sleeve 132 positioned about the upper end of bit 160. Upper end 140*a* of driver sub 140 may then be threaded to lower end 130*b* of case 130 via mating threads 190, 192. Driver sub 140 is preferably torqued to specification, with annular locking member 180 axially positioned and compressed between lower end 130*b* of case 130 and upper end 170*a* of retainer sleeve 170 as best shown in FIG. 10. With annular locking member 180 positioned between case 130 and retainer sleeve 170, at least one outer finger 183 of annular locking member 180 is moved into engagement with one of mating grooves in lower end 130*b* of case 130, and at least one outer finger 183 of annular locking member 180 is moved into engagement with one of mating grooves 198 in upper end 170*a* of retainer sleeve 170. In particular, free end 183*b* of at least one outer finger 183 is rotated relative to its fixed end 183*a* and body 181 about 90° upward in the direction of arrow 199*a* (FIG. 10) into one of mating grooves 191 in lower end 130*b* of case 130. In addition, free end 183*b* of at least one outer finger 183 of annular locking member 180 is rotated relative to its fixed end 183*a* and body 181 about 90° downward in the direction of arrow 199*b* (FIG. 10) into one of mating grooves 198 in upper end 170*a* of retainer sleeve 170. Upon engagement with grooves 191, 198, outer fingers 183 are oriented substantially parallel to axis 115 (FIGS. 11 and 12). Thus, outer fingers 183 that engage grooves 191, 198 may be described as having a first or pre-assembly position extending radially outward from annular locking member body 181 (FIGS. 6 and 10) and a second or post-assembly position extending substantially axially upward (into engagement with grooves 191) or axially downward (into engagement with grooves 198) from annular locking member body 181 (FIGS. 11 and 12). The deformation of free end 183*b* relative to its respective fixed end 183*a* and body 181 may be achieved by any suitable means including, without limitation, bending, folding, etc. In the embodiment shown in FIG. 11, fingers 182, 183 disposed in groove 191, 198, respectively are tack welded in place.

In this embodiment, configuring an outer finger to engage a groove 191, 198 requires the finger 182 to be substantially circumferentially or angularly aligned with the particular groove 191, 198. However, the circumferential or angular orientation of grooves 191, 198 relative to outer fingers 183 upon proper torquing of driver sub 140 to case 130 may vary from assembly to assembly or for a given assembly due to a variety of factors including, without limitation, the condition of threads 190, 192 (e.g., brand new, worn, degraded, etc.), thermal expansion or contraction of driver sub 140 and/or case 130, or combinations thereof. Consequently, it may be difficult to predict the final circumferential position of each outer finger 183 relative to each groove 198, 198 upon sufficient torquing. Therefore, as shown in FIGS. 10 and 11, the circumferential or angular spacing of outer fingers 183 may be different than the circumferential or angular spacing of grooves 191, 198. With such an arrangement, even if several outer fingers 183 are not sufficiently aligned with one or more grooves 191, 198, one or more other outer fingers 183 may be sufficiently aligned with one or more grooves 191, 198 for engagement therewith. As best shown in FIG. 11, any outer fingers 183 that do not engage a mating groove 191, 198 may be removed (e.g., cut off) such that they do not provide any interference during subsequent drilling operations. Alternatively, outer fingers 183 that do not engage a mating groove 191, 198 may be folded against the outer surface of case 130 or retainer sleeve 170 such that they do not provide any interference during subsequent drilling operations. In other embodiments, the angular spacing between the outer fingers (e.g., outer fingers 183) may be sufficiently small such that the driver sub (e.g., driver sub 140) may be torqued relative to the case (e.g., case 130) until the outer fingers substantially align with the grooves (e.g., grooves 191) on the case.

Since the primary purpose of locking member 180 is to restrict the rotation of driver sub 140 relative to case 130, one or more inner fingers 182 preferably engage with mating grooves 193 of driver sub 140 and one or more outer fingers 183 preferably engage with grooves 191 of case 130. However, engagement of one or more outer fingers 183 with mating grooves 198 in retainer sleeve 170 is optional. Consequently, in other embodiments, the upper end (e.g., upper end 170*a*) of the retainer sleeve (e.g., retainer sleeve 170) may comprise an annular recess or undercut rather than spaced apart grooves (e.g., grooves 198). Such a recess or undercut may be configured and sized to provide sufficient space to accommodate any of the outer fingers (e.g., outer fingers 183) that are not aligned and engaged with the grooves (e.g., grooves 182) in the case (e.g., case 130).

In general, annular locking member 180 may comprise any suitable material including, without limitation, metal or metal alloys, composites, or combinations thereof. However, since fingers 182 are bent, and preferably maintain their bent position engaging grooves 191, 198, annular locking member 180 preferably comprises a ductile material capable of maintaining its integrity and shape once bent such as a relatively high strength but ductile grade of alloy steel or a nonferrous material such as aluminum.

As shown in FIGS. 10-12, each inner finger 182 positively engages one of grooves 193 of driver sub 140, at least one outer finger 183 positively engages a groove 191 in case 130, and at least one outer finger 183 positively engages a groove 198 in retainer sleeve 170. The positive engagement of inner fingers 182 and grooves 193 restricts and/or prevents the rotational movement of annular locking member 180 relative to driver sub 140, the positive engagement of at least one outer finger 183 and at least one groove 191 restricts and/or prevents the rotational movement of annular locking member 180 relative to case 130, and the positive engagement of at least one outer finger 183 and at least one groove 198 restricts and/or prevents the rotational movement of annular locking member 180 relative to retainer sleeve 170. Without being limited by this or any particular theory, as case 130, driver sub 140, and retainer sleeve 170 are each restricted and/or prevented from rotation relative to annular locking member 180, they are also restricted and/or prevented from rotation relative to each other. By restricting and/or preventing the rotation of case 130 relative to driver sub 140, annular locking member 180 offers the potential to reduce and/or eliminate the likelihood of driver sub 140 unthreading relative to case 130, as well as tripping and fishing operations typically associated with a dropped downhole driver sub and bit. Although annular locking member 180 has been described as including at least one finger 182 that engages at least one groove 191 and at least on other finger 182 that engages at least one groove 198, without being limited by this or any particular theory, the greater number of grooves 191, 198 engages by fingers 182, the stronger the "lock" between case 130, driver sub 140, and retainer sleeve 170.

Although annular locking member 180 offers the potential to restrict and/or prevent the inadvertent unthreading of case 130 and driver sub 140, it should be appreciated that annular locking member 180 may be reconfigured relatively easily to allow the intentional unthreading of case 130 and driver sub 140. In particular, at the surface, outer fingers 183 may be moved out of engagement with grooves 191, 198 by rotating or pivoting free end 183*b* relative to fixed end 183*a* and out of groove 191, 198. Once each outer finger 182 is disengaged from groove 191, 198, driver sub 140 may be rotated relative to case 130 to unthread driver sub 140 and case 130.

While various preferred embodiments have been showed and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. A percussion drilling assembly for boring into the earth, the percussion drilling assembly coupled to a lower end of a drill string and comprising:

a tubular case having a central axis and a lower end;

a driver sub having an upper end threadingly engaged with the lower end of the case;

a annular locking member disposed about the driver sub, wherein the annular locking member engages the case and the driver sub, and restricts the rotation of the driver sub relative to the case about the central axis;

a hammer bit extending coaxially through the driver sub; and a retainer sleeve having an upper end disposed about a lower end of the driver sub and a lower end extending axially from the lower end of the retainer sleeve along an outer periphery of the hammer bit;

wherein the annular locking member is axially positioned between the lower end of the case and the upper end of the retainer sleeve; and wherein the annular locking member engages the retainer sleeve and restricts the rotation of the retainer sleeve relative to the case about the central axis.

2. The assembly of claim 1 wherein the annular locking member includes an annular body and an inner finger extending radially inward from the body;

wherein an outer surface of the driver sub includes a groove adapted to mate with the inner finger;

wherein the inner finger engages the groove in the driver sub.

3. The assembly of claim 2 wherein the annular locking member further includes a first outer finger extending axially upward from the body;

wherein the outer surface of the lower end of the case includes a groove adapted to mate with the first outer finger; and wherein the first outer finger engages the groove in the case.

4. The assembly of claim 3 wherein the annular locking member further includes a second outer finger extending axially downward from the body and circumferentially spaced from the first outer finger;

wherein an outer surface of the upper end of the retainer sleeve includes a groove adapted to mate with the second outer finger; and wherein the second outer finger engages the groove in the retainer sleeve.

5. The assembly of claim 4 wherein the groove in the driver sub, the groove in the case, and the groove in the retainer sleeve are each substantially parallel to the central axis.

6. The assembly of claim 4 wherein the annular locking member includes a plurality of inner fingers extending radially inward from the body, and wherein the outer surface of the driver sub includes a plurality of grooves, each groove adapted to mate with one of the inner fingers;

wherein each inner finger engages one of the grooves in the driver sub.

7. A method for drilling an earthen borehole, comprising:

(a) disposing a percussion drilling assembly downhole on a drillstring, wherein the percussion drilling assembly comprises:

a tubular case having a central axis and coupled to the drillstring;

a driver sub having an upper end threadingly coupled to a lower end of the case; and a hammer bit slidingly received by the driver sub;

(b) restricting the rotation of the driver sub relative to the case with an annular locking member disposed about the driver sub at the lower end of the case; and (c) restricting the axial disengagement of the hammer bit and the driver sub with a retainer sleeve coaxially coupled to the lower end of the driver sub.

8. The method of claim 7 wherein the annular locking member is disposed about the driver sub and axially positioned between an upper end of the retainer sleeve and the lower end of the case.

9. The method of claim 8 wherein the annular locking member comprises an annular body including at least one inner finger extending from the inner periphery of the body and a plurality of outer fingers extending from the outer periphery of the body.

10. The method of claim 9 wherein (b) comprises:

engaging a groove on an outer surface of the driver sub with the at least one inner finger; and engaging at least one groove on the outer surface of the lower end of the case with one of the outer fingers.

11. The method of claim 10 wherein (b) further comprises:

engaging at least one groove on an outer surface of the upper end of the retainer sleeve with one of the outer fingers.

* * * * *